US010279592B2

(12) United States Patent
Moya Rojo et al.

(10) Patent No.: US 10,279,592 B2
(45) Date of Patent: May 7, 2019

(54) WIPER WITH BIAS MEMBERS

(71) Applicant: HEWLETT-PACKARD DEVELOPMENT COMPANY, L.P., Houston, TX (US)

(72) Inventors: Oscar Moya Rojo, Sant Cugat del Valles (ES); Alejandro Mielgo, Sant Cugat del Valles (ES); Jordi Bas, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/903,331

(22) Filed: Feb. 23, 2018

(65) Prior Publication Data

US 2018/0178524 A1 Jun. 28, 2018

Related U.S. Application Data

(62) Division of application No. 15/263,735, filed on Sep. 13, 2016, now Pat. No. 9,956,782.

(51) Int. Cl.
*B41J 2/165* (2006.01)

(52) U.S. Cl.
CPC ..... *B41J 2/16535* (2013.01); *B41J 2/16544* (2013.01); *B41J 2002/1655* (2013.01)

(58) Field of Classification Search
CPC .... B41J 2/16585; B41J 2/16535; B41J 2/175; B41J 2/165; B41J 2/16547; B41J 2/16541; B41J 2/16544
USPC ..... 347/22, 33, 34
See application file for complete search history.

(56) References Cited

U.S. PATENT DOCUMENTS

| | | | |
|---|---|---|---|
| 4,829,318 | A | 5/1989 | Racicot et al. |
| 5,152,220 | A | 10/1992 | Lindner et al. |
| 6,511,155 | B1 | 1/2003 | Fassler et al. |
| 7,866,788 | B2 | 1/2011 | Jorba et al. |
| 8,562,104 | B2 | 10/2013 | Love et al. |
| 8,733,887 | B2 | 5/2014 | Inoue |
| 8,752,934 | B2 | 6/2014 | Bernard |
| 2008/0158291 | A1 | 7/2008 | Satake |
| 2013/0265366 | A1 | 10/2013 | Murayama et al. |
| 2014/0125734 | A1 | 5/2014 | Kobayashi |

*Primary Examiner* — Jannelle M Lebron
(74) *Attorney, Agent, or Firm* — HP Inc. Patent Department

(57) ABSTRACT

In an example, a print apparatus may include a print head assembly and a maintenance cartridge. An example maintenance cartridge may include a wiper system. An example wiper system may include a web wipe and a plurality of independently biased members adjacent each other with respect to a width of the web wipe. Another example wiper system may include a plurality of bias members, a plurality of carriers coupled to the plurality of bias members, and a plurality of rollers coupled to the plurality of carriers and located along a width of a wiping area.

20 Claims, 5 Drawing Sheets

WIPER WITH BIAS MEMBERS

BACKGROUND

A print device generally includes components to place print fluid on a print material. A print device may also include a service subsystem, such as a service carriage having a maintenance cartridge. The service subsystem is used to perform service on a component of the print device to enable the components to function at a level of operability. For example, the service system may perform a maintenance routine for a print head to enable the print head to continue to eject fluid.

DETAILED DESCRIPTION

In the following description and figures, some example implementations of wiper systems, maintenance cartridges, and print apparatus are described. In examples described herein, a "print apparatus" may be a device to print content on a physical medium (e.g., paper or a layer of powder-based build material, etc.) with a printing fluid (e.g., ink or toner). For example, a print apparatus may be a wide-format printing device that prints latex-based print fluid on a print medium, such as a print medium that is size A2 or larger, to produce an image on the print medium. In the case of printing on a layer of powder-based build material, the print apparatus may utilize the deposition of printing fluids in a layer-wise additive manufacturing process. A print apparatus may utilize suitable printing consumables, such as ink, toner, fluids or powders, or other raw materials for printing. In some examples, a print apparatus may be a three-dimensional (3D) printing device. An example of printing fluid is a water-based latex ink ejectable from a print head, such as a piezoelectric print head or a thermal inkjet print head. Other examples of print fluid may include dye-based color inks, pigment-based inks, solvents, gloss enhancers, etc.

A print apparatus may include a service carriage comprising a system to service components of the print apparatus, such as the print head. A maintenance cartridge of the service carriage may include a wiping system. The wiping system may include a web of a substrate, such as a cloth, also discussed as a "web wipe" herein. The web wipe may be used to clean a surface, such as the surface of a print head. A pass of the web wipe on a print head during a maintenance routine, for example, may remove excess print fluid from the print head surface, but may also induce air to be trapped inside a nozzle firing chamber which may prevent the nozzle from firing.

Various examples described below relate to providing independent bias forces on the wiping mechanism to allow for maintenance routines by the service station that are adaptive to the surface of the print head, for example. By providing independent bias forces on the web wipe, the web wipe may, for example, adapt to the surface of print head and provide independent wiping force on each die on the print head (e.g., each row of dies on the print head). Nozzles wiped with proper independent force may reduce the number of nozzles disabled by trapped air, for example.

The terms "include," "have," and variations thereof, as used herein, mean the same as the term "comprise" or appropriate variation thereof. Furthermore, the term "based on," as used herein, means "based at least in part on." Thus, a feature that is described as based on some stimulus may be based only on the stimulus or a combination of stimuli including the stimulus.

Figure 1:
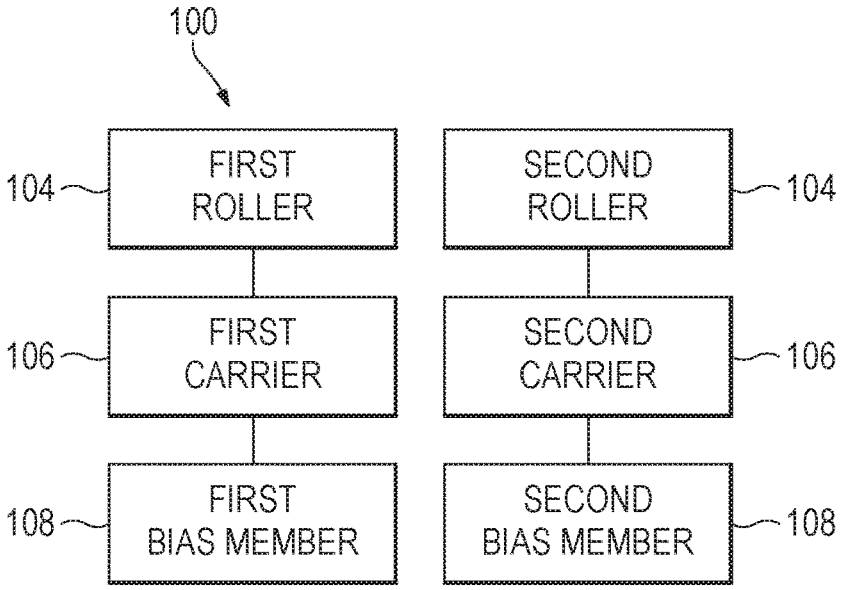
FIGS. 1 and 2 are block diagrams depicting example wiper systems.

FIG. 1 is a block diagram depicting an example wiper system 100. The wiper system 100 generally includes a plurality of rollers 104 held by a plurality of carriers 106, where the plurality of carriers 106 are independently biased by a plurality of bias members 108. As shown in FIG. 1, a first carrier 106 of the plurality of carriers 106 is coupled to a first bias member 108 of the plurality of bias members 108 and a first roller 104 of the plurality of rollers 104 is coupled to the first carrier 106. Similarly, a second carrier 106 of the plurality of carriers 106 is coupled to a second bias member 108 of the plurality of bias members 108 and a second roller 104 of the plurality of rollers 104 is coupled to the second carrier 106.

The rollers 104 may be cylindrical in shape and may have hollow interiors that are able to be coupled to the carriers. The rollers 104 may rotate to assist movement of the web wipe over the rollers. The rollers may be made of foam or other substrate that is compressible.

The carriers 106 may be made of a material firmer than the rollers. For example, the carrier may be a frame of metal or plastic on which the soft foam rollers are placed.

The bias members 108 may be any appropriate mechanism to provide a bias force. For example, the bias members may be any appropriate spring. The bias members may provide force in addition to any bias offered by the rollers, which may include a compression force due to the material of the rollers, for example.

Figure 2:
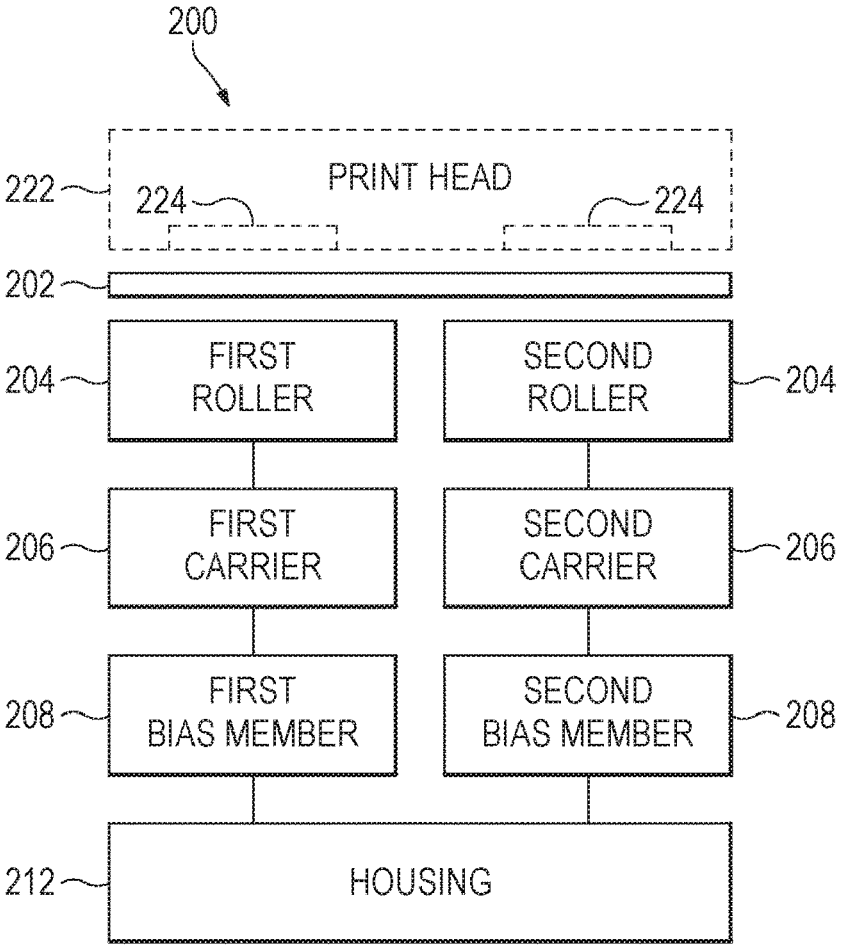

Referring to FIG. 2, FIG. 2 is a block diagram depicting an example of a wiper system 200 usable to perform a maintenance routine on a print head 222. A wiper system 200 may be coupled to the housing 212 of a maintenance carriage, such as a top case. The wiper system 200 includes components similar to the components of the wiper system 100 of FIG. 1. For example, the plurality of rollers 204, the plurality of carriers 206, and the plurality of bias members 208 may be the same as the plurality of rollers 104, the plurality of carriers 106, and the plurality of bias members 208 of FIG. 1 respectively.

A web 202 is shown in FIG. 2. The web 202 is material used for contacting the print head surface during a maintenance routine. The plurality of rollers 204 may be in contact with or otherwise provide a force via the plurality of bias members 208 a web in contact with the plurality of rollers, wherein cylindrical interiors of the plurality of rollers are substantially aligned along a same axis. For example, the wiper system 200 may include a plurality of carriers 206 (that are operationally independent) having sections for holding the a plurality of rollers 204 and a plurality of independently biased members 208 coupled to the plurality of the carriers 206 so that each of the plurality of bias members 208 are able to apply a force on a corresponding carrier 206 in a direction towards the web 202 via contact with rollers 204 coupled to the corresponding carriers 206.

In this manner, the force(s) of the web 202 to wipe the dies 224 of the print head 222 are enhanced, for example, by the independent forces provided by the first set of roller, carrier, and bias member combination and the second set of roller, carrier, and bias member combination.

The plurality of rollers 204 (e.g., the first roller 204 and the second roller 204) are located along a width of a wiping area to, for example, cover the width of the wipe that is to press against a print head during a maintenance routine. For example, the bias members 208 are aligned with the dies 224 of the print head 222 such that the force of the bias members 208 align with the pressure centers of the rollers 204 (e.g., based on the location of the dies 224 on the print head 222). By providing the plurality of rollers 204 along the width of the wiping area the surfaces of the print head 222, such as the dies 224 which may be in rows with respect to the wiping direction, may have their own independent force to allow for individualized wiping using the wipe because each of the bias members 208, for example, are physically separate or otherwise able to provide individualized and independent bias force on a corresponding carrier 206. For example, the plurality of bias members 208 may provide the independent bias forces to the support areas of the plurality of carriers 206 to allow the first carrier 206 to move independent of the second carrier 206 and allow for the first roller 204 to press against the web 202 independent of the operation of the second roller 204 pressing against the web 202. Thus, the independent bias forces applied via the plurality of bias members allows for the web wipe 202 to adapt to the surface contour of the print head surface. In this manner, the print head 222 may have dies 224 that are individually maintained. For example, the printing surface may have a plurality of dies 224 that are in a staggered orientation on the print head surface, such as on a page wide array print head, where a roller, carrier, and bias member combination may be implemented on the maintenance carriage for each row of print head dies 224 based on the staggered formation of the dies (e.g., staggered rows of dies which may or may not overlap with regards to the printing direction). The plurality of independently biased members 208 may be positioned at pressure centers of forces between the plurality of rollers 204 and the dies 224 of the print head 222.

The web 202 may be any appropriate substrate usable to clean the nozzles of the print head dies 224. For example, the web may be a cloth or other textile. The web 202 may be a replaceable substrate or a continuous fabric, for example, circulated by the maintenance cartridge to move a section of the web 202 to the wiping area for use in a maintenance routine.

Other example wiper systems may include web supports without the components of FIG. 2. For example, a printer service station may use a non-rotating, rubber nip, possibly with a pointy shape. Independent bias members may be usable with other such systems in accordance with the description herein.

Figure 3:
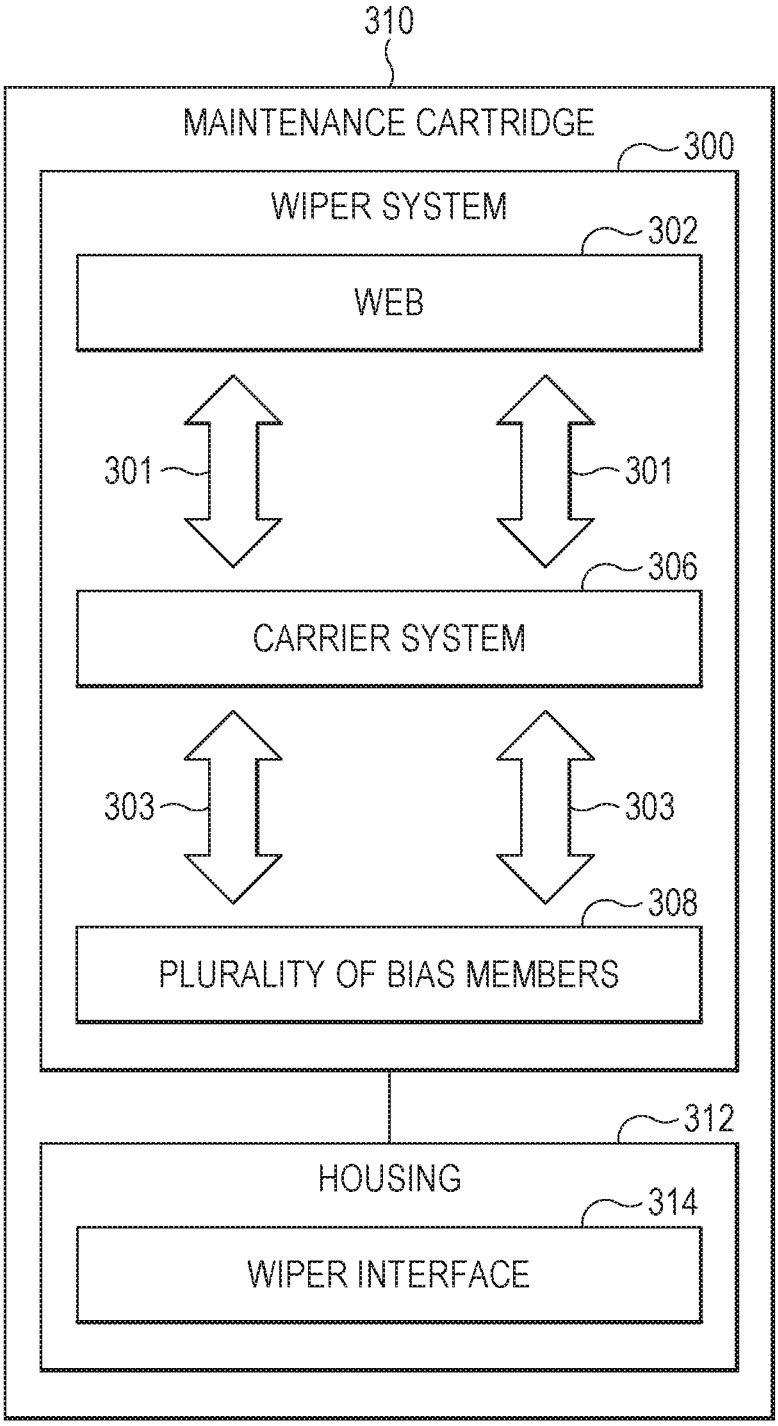
FIG. 3 is block diagram depicting an example maintenance cartridge.

FIG. 3 is a block diagram depicting an example maintenance cartridge 310. The example maintenance cartridge 310 of FIG. 3 includes a wiper system 300 coupled to a housing 312 via a wiper interface 314 (e.g., a surface defining a plurality of channels into which the wiper system 300 may be securely inserted so that the wiper system 300 rigidly moves with service carriage).

The wiper system 300 of FIG. 3 includes a web 302, a carrier system 306, and a plurality of bias members 308. The plurality of bias members 308 independently provide bias to the carrier system 306 as shown by forces 303. The carrier system 306 may then transfer the independent forces 303 to provide independent forces 301 on the web 302. For example, the plurality of bias members 308 may be positioned such that the independent bias forces 303 (and 301) apply in directions towards pressure centers of the plurality of rollers (not shown) connect to the carrier system 306. In other examples, rollers may not be implemented on the wiper system and the carrier system 306 may provide the independent forces 301 on the web directly.

Figure 4:
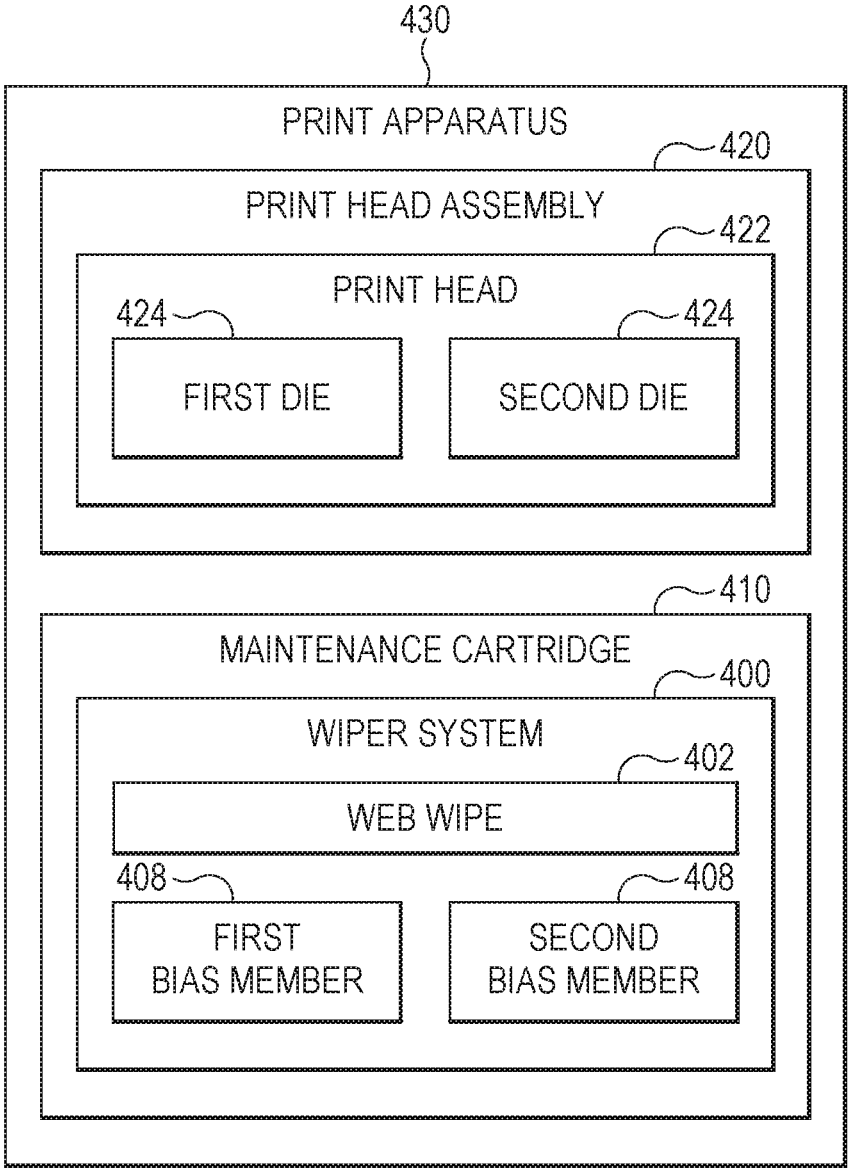
FIG. 4 is a block diagram depicting an example print apparatus.

FIG. 4 is a block diagram depicting an example print apparatus 430. The printing apparatus 430 generally includes a print head assembly 420 and a maintenance cartridge 410 to perform service routines on the print head 422 (e.g., wipe the dies 424 of the print head 422). The print head assembly 422 has a print head interface to receive the print head 422, for example, which orients the print head dies 424 towards a print zone.

The maintenance cartridge 410 may include a wiper system 400 for wiping dies 424 of the print head 422. The wiper system 400 shown in FIG. 4 includes a web wipe 402 and a plurality of independently biased members 408. The plurality of independently biased members may provide independent bias forces on the web wipe 402, either directly or indirectly, such as via a carrier and/or roller.

Figure 5:
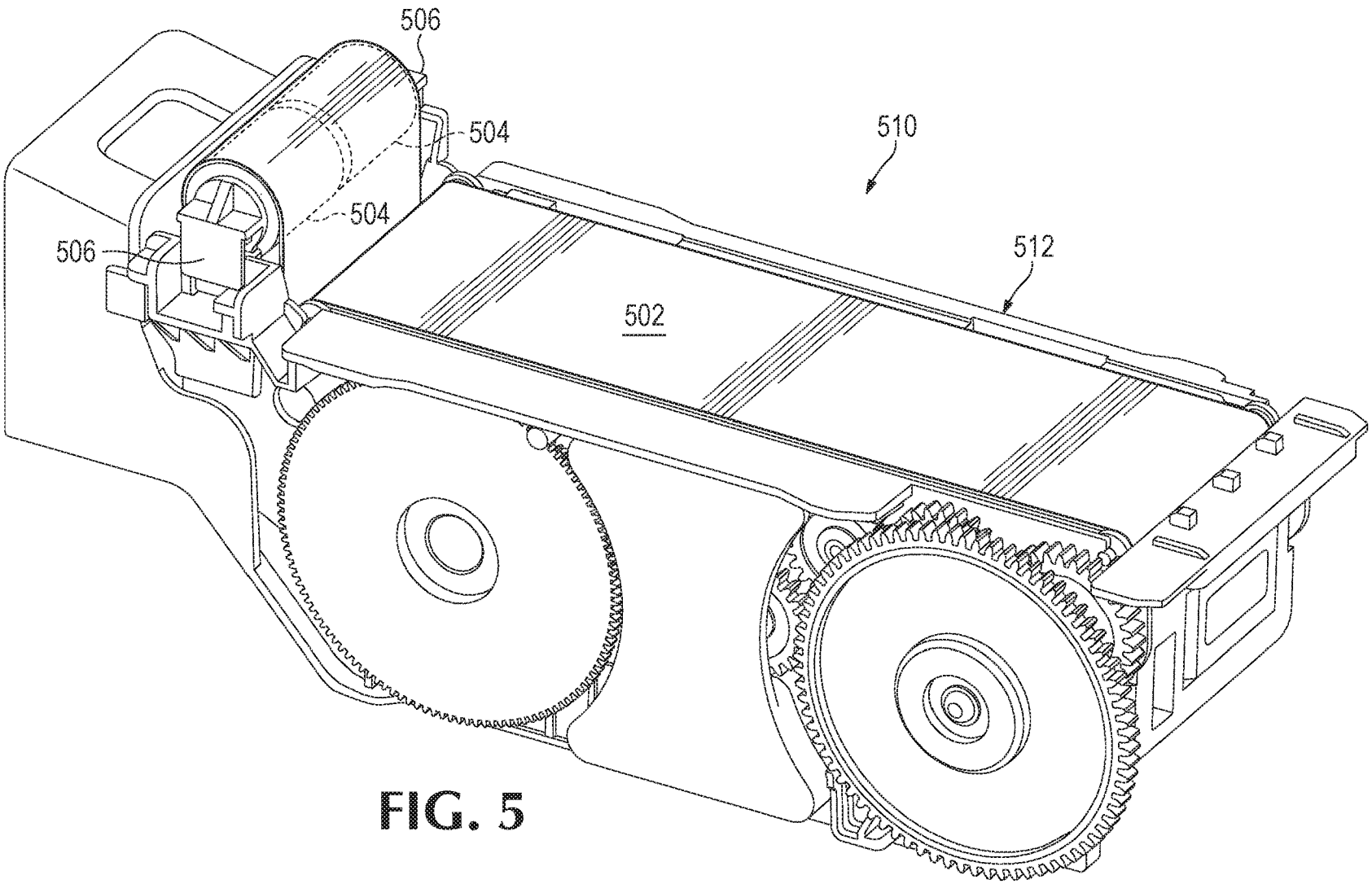
FIG. 5 is a perspective view of an example maintenance cartridge.

FIG. 5 is a perspective view of an example maintenance cartridge 510. The maintenance cartridge 510 generally includes a housing 512 and a web wipe 502. The web wipe 502 may be a continuous strip that circulates through the housing 512 where a portion of the web wipe 502 is pushed up away from the housing 512 (by the rollers 504 of the wiper system) to be used as a wiping area. A web wipe 502 covers the rollers 504 held in place by the carriers 506. Though not shown in FIG. 5, the plurality of independently biased members may be placed adjacent each other with respect to a width of the web wipe 502 to correspond with the alignment of the rollers 504 along the width of the web wipe 502. For example, the plurality of rollers 504 may be placed under the web wipe 502 in a row across the web wipe. In other examples, the rollers 504 may be located to cover the width of the web wipe 502, but may also be staggered and/or overlap across or with respect to the width of the web wipe 502. In this manner, the bias force from the bias members transfers via the rollers 504 to provide multiple independent forces on the web wipe 502, such as each of the pressure centers of the rows of dies of a print head to be serviced. In yet another example, additional sets of rollers may be place along the length of the web wipe to provide redundant wiping capabilities, as long as a group of the rollers is aligned with respect to the width of the web wipe and independently biased.

Figure 6:
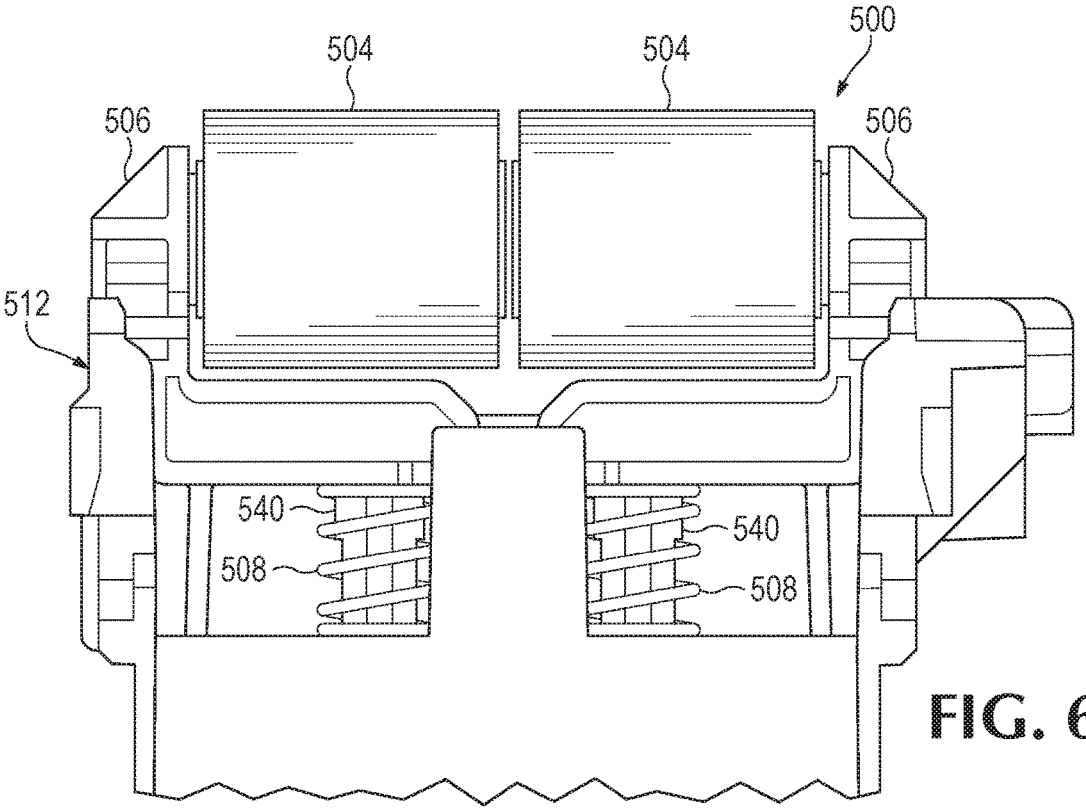
FIG. 6 is a partial view of an example wiper system without a web wipe.

FIG. 6 is a partial view of an example wiper system 500 without a web wipe shown. The rollers 504 are held in place by carriers 506 and the carriers 506 are independently biased by springs 508. The housing 512 of the maintenance cartridge acts as a wall to compress the spring 508 when the rollers 504 are pressed down towards the maintenance carriage.

Figure 7:
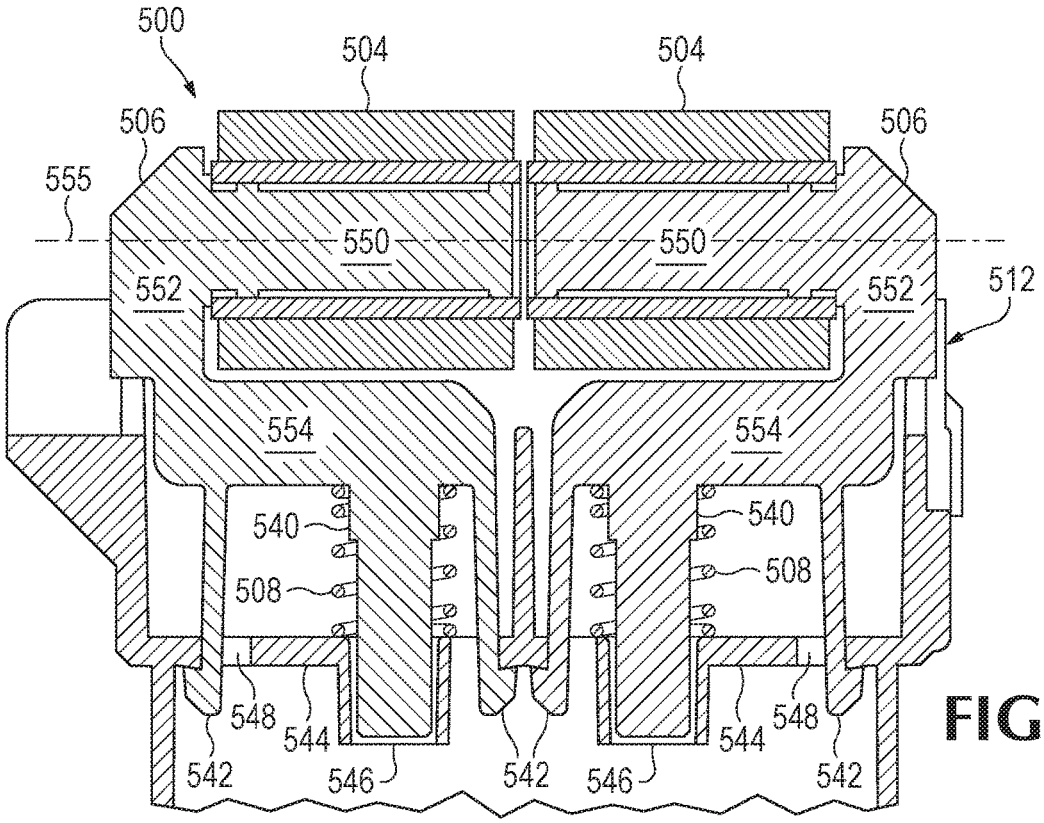
FIG. 7 is a cross sectional view of the example wiper system of FIG. 6.

FIG. 7 is a cross sectional view of the example wiper system of FIG. 6. The body member of the carriers 506 of FIG. 7 include a roller holding area 550, a support 552, a base 554, and a plurality of guide members, such as neck 540 and legs 542. The rollers 504 are placed on roller holding areas of the body member of the carrier 506. The plurality of guide members may assist the carrier 506 in directing movement with respect to the web wipe (e.g., vertical movement) to be within a tolerance (e.g., within a tolerance of horizontal movement). The neck 540 couples to the base 554 so that the spring 508 places a force on the base 554 at the location of the neck and opposite the roller holding section 550. For example, the support may be substantially vertical and substantially perpendicular to the substantially horizontal cantilever; the base may be substantially perpendicular to the support and substantially parallel with the roller holding area; and the guide members may be substantially vertical and substantially perpendicular to the base.

The roller holding area 550 may be substantially cylindrical to assist or guide rotation of the rollers 504. The roller holding area 550 may act as a cantilever which anchors to the support 552 and the support 552 couples to the base 554 to transfer the force from the bias member 508 on the base 554 to change the vertical location of the roller holding area (e.g., moves the axis of rotation of the roller 504). The roller holding areas 550 of the plurality of carriers 508 may align along a same axis 555 when at rest. The cantilever is usable to hold the roller, which may, for example, minimize the distance between foam rollers, and/or maximize the amount of print head surface area able to be cleaned by the wiper system 500.

The movement of the carrier may be guided by the legs 542, which may include stops as feet of the legs, and the neck 540, which may be locatable within an aperture or indentation of the housing surface 544. For example, the springs 508 wrap around the necks 540 of the carriers 506 to direct the spring force. The plurality of guide members may fit in the wiper interface of the maintenance cartridge housing 512 through a plurality of channels, such as channels 548. The housing surface 544 may define the interface, such as the plurality of channels 548. In FIG. 7, the legs 542 fit in apertures 548 defined by the surface 544 and the neck 540 fits in a channel defined by walls 546 to guide the neck as the neck moves corresponding to the force of the spring 508 and external forces (e.g., the print head on the web wipe). The plurality of guide members, such as legs 542, may be biased to assist in maintaining the horizontal position of the carriers. For example, the legs 542 are insertable into the apertures 548 of the wiper interface (e.g., the housing surface 544) and provide an outward force on walls of the surface 544 defining the apertures 548 to substantially lock the wiper system 500 in place in the x and y direction on the housing 512 and allow for movement in the z direction. In this manner, the plurality of guide members are locatable within the plurality of channels of the wiper interface such that the forces of the plurality of independently biased members (e.g., the springs 508) move the plurality of carriers 506 along a substantially perpendicular direction to the dies of the print head (based on a force of a print head surface of the print head against the web wipe and the surface contour of the print head surface).

The body member of the first carrier 506 and the body member of the second carrier 506 may be substantially symmetrically aligned so that the body member of the first carrier 506 directs the roller holding section 550 of the first carrier 506 in a direction of the roller holding section 550 of the second carrier 506. For example, the frames of the carriers 506 may be physically separate components that mirror in orientation with respect to each other. By maintaining symmetry in this manner, the rollers 504 may be held by the interior cylindrical surfaces so that the wiper system 500 may, for example, clean in both directions with the substantially similar performance. The rollers 504 of wiper system 500 in FIG. 7 do not overlap with respect to the lanes of the wiping area. In other examples the rollers may be staggered and overlap with respect to the lanes of the wiping area (e.g., rows of print head dies).

Any implementation may be assisted by having a number of independently biased members greater than one providing force with respect to the web wipe. For example, an independently biased member may be used for each row of dies of a print head so that at any given point of the maintenance routine along the surface of the print head a roller corresponds to a die and the die has an independent bias force at a pressure center of the roller. Such independent bias force may provide, for example, adaptive and individualized maintenance routines to reduce wipe-induced nozzle-out effects.

All of the features disclosed in this specification (including any accompanying claims, abstract and drawings), and/or all of the elements of any method or process so disclosed, may be combined in any combination, except combinations where at least some of such features and/or elements are mutually exclusive.

The present description has been shown and described with reference to the foregoing examples. It is understood, however, that other forms, details, and examples may be made without departing from the spirit and scope of the following claims. The use of the words "first," "second," or related terms in the claims are not used to limit the claim elements to an order or location, but are merely used to distinguish separate claim elements.

What is claimed is:

1. A printing apparatus comprising:
a print head assembly having a print head interface to receive a print head; and
a maintenance cartridge comprising a wiper system for wiping dies of the print head, the wiper system comprising:
a web wipe; and
a plurality of independently biased members adjacent each other with respect to a width of the web wipe, the plurality of independently biased members to provide independent bias forces on the web wipe;
wherein each biased member provides an independent biasing force toward the print head interface so as to wipe a print head with the web wipe.

2. The printing apparatus of claim 1 comprising:
a plurality of rollers in contact with the web wipe, wherein cylindrical interiors of the plurality of rollers are substantially aligned along a same axis.

3. The printing apparatus of claim 1, wherein the wiper system further comprises:
a plurality of carriers having sections for holding a plurality of rollers,
wherein the carriers are operationally independent, and the plurality of independently biased members are coupled to the carriers to apply a force on the carriers in a direction towards the web wipe in contact with the rollers.

4. The printing apparatus of claim 3, wherein each carrier of the plurality of carriers comprises:
a cylindrical roller holding area;
a support area coupled to the cylindrical roller holding area; and
a neck coupled to the support area.

5. The printing apparatus of claim 3, wherein:
the plurality of independently biased members are positioned at pressure centers of forces between the plurality of rollers and the dies of the print head.

6. The printing apparatus of claim 5, wherein:
the maintenance cartridge includes a housing having a surface defining a plurality of channels; and the wiper system comprises a plurality of guide members coupled to the plurality of carriers, the plurality of guide members located within the plurality of channels such that the plurality of independently biased members moves the plurality of carriers along a substantially perpendicular direction to the dies of the print head based on a force of a print head surface of the print head against the web wipe and a surface contour of the print head surface, the plurality of dies are in a staggered orientation on the print head surface.

7. The printing apparatus of claim 3, wherein each of a first carrier and a second carrier of the plurality of carriers includes a body member comprising:

a neck; and a roller holding section opposite to the neck.

8. The printing apparatus of claim 7, wherein the body member further comprises:

a cantilever, the cantilever to include the roller holding area;

a support coupled to the cantilever;

a base coupled to the support; and a plurality of guide members coupled to the base.

9. The printing apparatus of claim 7, wherein:

a first bias member comprises a first spring to wrap around the neck of the first carrier; and a second bias member comprises a second spring to wrap around a neck of the second carrier.

10. The printing apparatus of claim 7, wherein:

the body member of the first carrier and the body member of the second carrier are symmetrically aligned so that the body member of the first carrier directs the roller holding section of the first carrier in a direction of the roller holding section of the second carrier;

the plurality of rollers do not overlap with respect to the wiping area; and the first carrier and the second carrier are physically separate components and mirror in orientation with respect to each other.

11. A printing apparatus comprising:

a print head assembly having a print head interface to receive a print head; and a maintenance cartridge comprising a wiper system for wiping dies of the print head, the wiper system comprising:

a web wipe; and a plurality of independently biased members adjacent each other with respect to a width of the web wipe, the plurality of independently biased members to provide independent bias forces on the web wipe.

12. The printing apparatus of claim 11, wherein each biased member provides an independent biasing force toward the print head interface so as to wipe a print head with the web wipe.

13. The printing apparatus of claim 11, wherein the print head is incorporated into the maintenance cartridge for installation in the printing apparatus.

14. The printing apparatus of claim 11, further comprising a print head in the print head interface, wherein the print head comprises a plurality of dies, wherein the biasing force for each bias member is toward a respective die of the print head.

15. The printing apparatus of claim 11, wherein the wiper system further comprises:

a plurality of carriers having sections for holding a plurality of rollers, wherein the carriers are operationally independent, and the plurality of independently biased members are coupled to the carriers to apply a force on the carriers in a direction towards the web wipe in contact with the rollers.

16. The printing apparatus of claim 15, wherein the plurality of carriers to allow a first carrier to move independently of a second carrier wherein a first roller presses against the web independent of a second roller pressing against the web.

17. The printing apparatus of claim 15, wherein the rollers are staggered across a width of a wiping area, corresponding to a configuration of dice of the print head in the wiping area to be cleaned.

18. The printing apparatus of claim 15, wherein each carrier comprises legs inserted into an aperture of a wiper interface, the legs providing an outward force on sides of the aperture with feet at the end of the legs, wherein the legs and feet permit movement of the carrier toward a wiping area but limit lateral movement.

19. The printing apparatus of claim 15, wherein:

the plurality of independently biased members are positioned at pressure centers of forces between the plurality of rollers and the dies of the print head.

20. The printing apparatus of claim 19, wherein:

the maintenance cartridge includes a housing having a surface defining a plurality of channels; and the wiper system comprises a plurality of guide members coupled to the plurality of carriers, the plurality of guide members located within the plurality of channels such that the plurality of independently biased members moves the plurality of carriers along a substantially perpendicular direction to the dies of the print head based on a force of a print head surface of the print head against the web wipe and a surface contour of the print head surface, the plurality of dies are in a staggered orientation on the print head surface.

* * * * *